US006257300B1

(12) United States Patent
Brownlie

(10) Patent No.: US 6,257,300 B1
(45) Date of Patent: Jul. 10, 2001

(54) ROMAN SHADE FOLD FORMING BATTEN

(75) Inventor: Michael Andrew Brownlie, Croydon (AU)

(73) Assignee: Sbriggs PTY LTD, Thomastown (AU)

( * ) Notice: Subject to any disclaimer, the term of this patent is extended or adjusted under 35 U.S.C. 154(b) by 0 days.

(21) Appl. No.: 09/297,812

(22) PCT Filed: Nov. 5, 1997

(86) PCT No.: PCT/AU97/00745

§ 371 Date: May 6, 1999

§ 102(e) Date: May 6, 1999

(87) PCT Pub. No.: WO98/20226

PCT Pub. Date: May 14, 1998

(30) Foreign Application Priority Data

Nov. 5, 1997 (AU) ..... 97-44334

(51) Int. Cl.[7] ..... E06B 3/48

(52) U.S. Cl. ..... 160/84.01; 160/84.04; 160/264

(58) Field of Search ..... 160/84.01, 264, 160/84.04, 84.05

(56) References Cited

U.S. PATENT DOCUMENTS 5,273,096 * 12/1993 Thomsen et al. ..... 160/84.01
5,862,850 * 1/1999 Yang ..... 160/84.01

FOREIGN PATENT DOCUMENTS

74080/91 * 10/1991 (AU) .
296 09 273 U1 * 10/1996 (DE) .
0 482 794 A1 * 4/1992 (EP) .
0 518 761 A1 * 12/1992 (EP) .
2 283 278 * 3/1976 (FR) .
1436957 * 5/1976 (GB) .
283924 * 8/1996 (TW) .
WO 90/15913 * 12/1990 (WO) .
WO 97/32105 * 9/1997 (WO) .

* cited by examiner

*Primary Examiner*—Blair M. Johnson
(74) *Attorney, Agent, or Firm*—Michael Best & Friedrich LLP; Grady J. Frenchick

(57) ABSTRACT

A roman shade fold forming batten including retaining means (1) to receive and releasably retain a fold of material (8) formed tansversely in a length of material; and suspension mounting means (7) located at one or more predetermined locations on the retaining means to receive suspension means (9).

2 Claims, 2 Drawing Sheets

ROMAN SHADE FOLD FORMING BATTEN

FIELD OF THE INVENTION

The invention relates to a roman shade fold forming batten.

BACKGROUND TO THE INVENTION

Traditionally roman shades have been formed by providing integrally located transverse battens at predetermined distances down a length of material. By attaching drawing cords to the material or battens it is possible to give the appearance of discrete lengths of material which can be drawn successively. This is essential to the roman shade style of window covering.

However the traditional roman shade is very labour intensive to manufacture. It requires the formation of batten pockets and stitching to connect the cords. As such roman shades are usually manufactured in standard drops designed for the more common window length.

When the drop of a window is unconventional it is necessary to have the roman shade especially made. This is expensive and there are significant delays in the delivery times of such shades.

Accordingly it is an object of the present invention to simplify the manufacture of roman shades.

SUMMARY OF THE INVENTION

According to one form of the invention a roman shade fold forming batten comprising (a) retaining means having (i) a front portion to receive and releasably retain a fold of material formed transversely in a length of material and (ii) a rear portion; and (b) suspension mounting means having (i) a first end connected to at least one predetermined location on the rear portion of the retaining means and (ii) a second end remote from the first end having an aperture formed therein to receive the suspension means.

In a first preferred embodiment of the invention, the suspension means has a first end which is a removable clip. Preferably the suspension means has a second end which is a ring defining the aperture and having an internal diameter substantially greater than the diameter of the suspension means passing through the ring.

In a preferred embodiment of the invention, the retaining means is an elongated member having at least one longitudinal open mouthed cavity to receive and releasably retain the fold of material. Typically the open mouth of the or each cavity has a width approximately equal to the width of the fold of material.

In a further preferred embodiment, the retaining means further comprises locking means to retain the fold of material in the or each cavity. Typically the locking means comprises at least one locking member locatable in the or each cavity and sandwiching the fold of material between the locking member and the or each cavity. Preferably the or each locking member has a cross-sectional profile which approximates the cross-sectional profile of the or each cavity. For example the cross-section may be circular.

Preferably the suspension mounting means is a clip or ring to receive the suspension means.

With this type of batten it is possible to quickly and easily manufacture the roman shade or provide a kit for doing so. It is also possible for consumers to create such a shade themselves without specialist assistance.

DESCRIPTION OF THE DRAWINGS

The invention will now be further exemplified with reference to the drawings. The embodiments are illustrative practical embodiments and do not limit the concept of the invention.

In the drawings:

Referring to FIGS. 1 and 2 it can be seen that the section 1 has a flange 2 with a node 3 allowing for the attachment of a cord guide ring at any position along its length.

Typically the section 1 has the shape of a ¾ circle or the letter "C". It has an opening 4 which is large enough to accommodate fabric 5 to be inserted along its length.

A round rod 6 may be fed in from either end of section 1.

Figure 1:
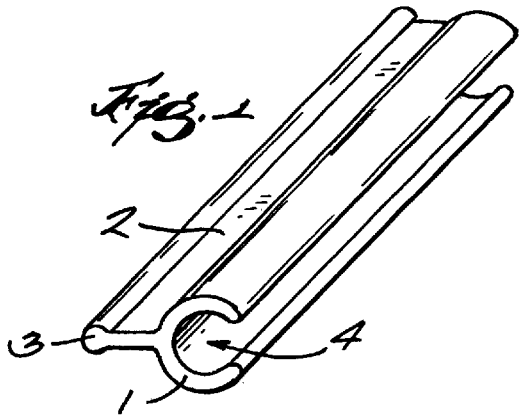
FIG. 1 shows the "C" section with flange according to this invention.
Figure 2:
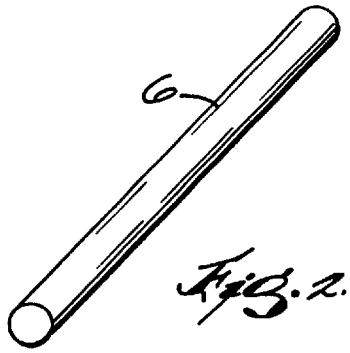
FIG. 2 shows the solid round rod according to this invention.
Figure 3:
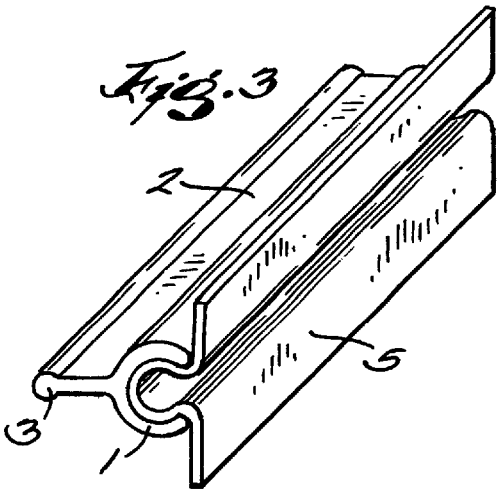
FIG. 3 shows the application of the "C" section to a piece of cloth.

Referring to FIG. 3 it can be seen that fabric 5 has been inserted into the opening of 4. The "C" section 1 thus forming a folding point in the fabric 5.

Figure 4:
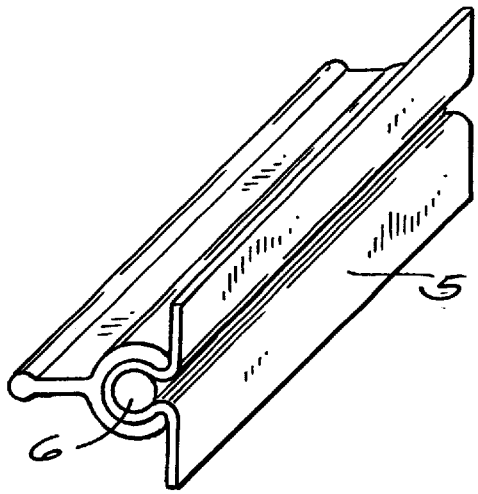
FIG. 4 shows the solid round rod used in conjunction with the "C" section locking the cloth into its position inside the "C" section.

Referring to FIG. 4 it can be seen that the solid round rod 6 has been inserted into the "C" section 1 to prevent the fabric 5 from escaping from the "C" section 1.

Figure 5:
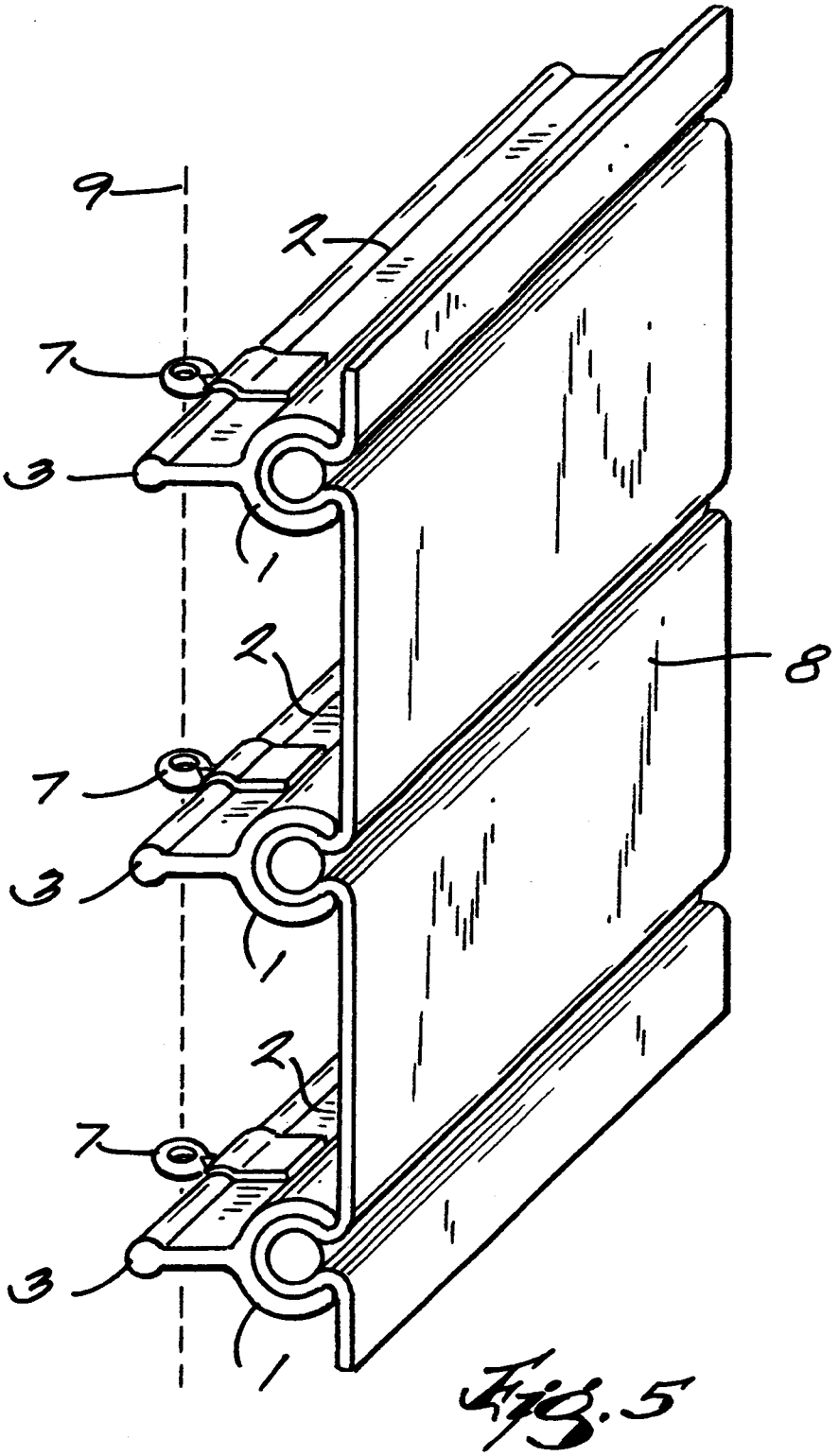
FIG. 5 shows a roman shade made of several attached "C" sections.

Referring to FIG. 5 it can be seen that with several "C" sections 1 attached with cord guide rings 7 it has created a roman shade 8. A cord 9 may be attached to the guide rings 7.

The word 'comprising' and forms of the word comprising as used in this description and in the claims does not limit the invention claimed to exclude any variants or additions which are obvious to the person skilled in the art and which do not have a material effect upon the invention.

The claims defining the invention are as follows:

1. A roman shade fold forming batten, comprising:

an elongated retaining member including a substantially C-shaped section having an inner surface, an outer surface and opposite ends, said C-shaped section defining an opening such that said C-shaped section receives and releasably retains a fold of material formed transversely in a sheet material, said retaining member further including a flange extending from said outer surface substantially between said opposite ends of said C-shaped section, said flange having a first side, a second side, and an elongated bulbous end connecting said first side to said second side;

a suspension mounting device being removably attachable to said retaining member, said suspension mounting device including a clip portion having a generally cylindrical engagement portion and a pair of generally parallel leg members extending from said engagement portion, said suspension mounting device further including a generally circular ring portion having an aperture therethrough, such that when it is desirable to attach said suspension mounting device to said retaining member, said clip portion is positioned onto said flange such that one of said leg members engages said first side of said flange, the other of said leg members engages said second side of said flange and said cylindrical engagement portion receives and engages said bulbous end of said flange, and such that when it is desirable to remove said suspension mounting device from said retaining member, said clip portion is removed from said flange; and a chord passable through said aperture in said ring portion and operably connectable to said retaining member and said ring portion for folding and unfolding the sheet of material.

2. A roman shade fold forming batten according to claim 1, further comprising:

one or more additional retaining members substantially similar to the first retaining member, each of said retaining members being spaced apart and substantially parallel to one another; and one or more additional suspension mounting devices, one for each additional retaining member, said additional suspension mounting devices being substantially similar to the first suspension mounting device, said chord passing through each aperture of each ring portion and being operably connectable to each retaining member and each ring portion for folding and unfolding the sheet of material.

* * * * *